US006386245B1

(12) United States Patent
Lajoie et al.

(10) Patent No.: US 6,386,245 B1
(45) Date of Patent: May 14, 2002

(54) REDUCTION OR PREVENTION OF CONTAINER DEFORMATION DUE TO SOLUTIONS CONTAINED THEREIN

(75) Inventors: M. Stephen Lajoie, Basking Ridge; Benny Yam, Holmdel; Peter J. Fallat, II, Branchburg, all of NJ (US)

(73) Assignee: Church & Dwight Co., Inc., Princeton, NJ (US)

( * ) Notice: Subject to any disclaimer, the term of this patent is extended or adjusted under 35 U.S.C. 154(b) by 0 days.

(21) Appl. No.: 09/776,461

(22) Filed: Jan. 23, 2001

(51) Int. Cl.[7] ..... B65B 1/04
(52) U.S. Cl. ..... 141/1; 141/98; 141/67
(58) Field of Search ..... 141/1, 2, 18, 37, 141/39, 40, 64–66, 98, 9, 100, 67

(56) References Cited

U.S. PATENT DOCUMENTS 5,400,601 A * 3/1995 Germain et al. ..... 141/64
5,566,730 A * 10/1996 Liebmann, Jr. ..... 141/64

OTHER PUBLICATIONS

Thomas et al; The Influence of Henry's Law on Bicarbonate Equilibria; Jour. AWWA Mar. 1970 pp. 185–187.

* cited by examiner

*Primary Examiner*—Steven O. Douglas
(74) *Attorney, Agent, or Firm*—Irving M. Fishman

(57) ABSTRACT

A method of preventing a deformable container from deforming when it contains a solution, which solution contains a dissolved gas or a species which under storage conditions is capable of generating a gaseous species is disclosed. The method is to provide a headspace in the container which headspace is enriched in the gaseous species which the solution is prone to give up to the atmosphere in the absence of such enrichment.

14 Claims, No Drawings

REDUCTION OR PREVENTION OF CONTAINER DEFORMATION DUE TO SOLUTIONS CONTAINED THEREIN

CROSS-REFERENCE TO RELATED APPLICATIONS

Not Applicable

STATEMENT REGARDING FEDERALLY SPONSORED RESEARCH OR DEVELOPMENT

Not Applicable

FIELD OF THE INVENTION

The present invention relates to the field of aqueous formulations containing dissolved gases and the packaging thereof in deformable containers. The invention further relates to commercial storage and shipping of such formulations in such containers.

BACKGROUND OF THE INVENTION

Aqueous solutions containing dissolved gases are used in a number of commercial products. One of the most commonly used dissolved gases is carbon dioxide, which is present in carbonated beverages. In addition, dissolved carbon dioxide gas is present in aqueous solutions having dissolved bicarbonate ions from whatever source. In solutions having bicarbonate ions, the following species are in a complex equilibrium with each other: carbon dioxide in the gaseous state, carbon dioxide dissolved in the liquid phase, carbonic acid, bicarbonate ion, and carbonate ion. Depending upon the pH, the pressure of the system, and the temperature, dissolved carbon dioxide may or may not be given up by the liquid phase to the atmosphere or taken up by the liquid phase from the atmosphere. As the concentration of carbon dioxide and carbon dioxide generating species are increased in the solution, equilibrium will favor loss of the carbon dioxide to the environment.

In closed systems, this loss of carbon dioxide from the liquid phase to the headspace results in pressurization of the container in which the formulation is enclosed. In containers that are designed to be non-deforming under pressure, such as carbonated beverage bottles, there is a limited amount of space for the gas to be contained and the evolution of gas stops. However, in containers of other shapes made of deformable materials, internal pressures normally encountered can deform the container, creating a larger volume inside the container, which allows the contents to settle lower and create additional headspace inside the container, which allows for additional gas to evolve from the liquid phase, repeating the cycle. The net effect is that the container no longer appears full, the container takes on a distorted shape, and there is an erroneous perception that the product inside the container is under filled. These same issues arise with other dissolved gases in aqueous solutions with deformable containers.

One commercial area where deformable containers in combination with dissolved gaseous species are used is in the mouthwash area. When aqueous bicarbonate containing mouthwashes are enclosed in such containers, and the containers are stored under warm conditions such as those which may be found in post-manufacture shipping during the warmer months, significant container bloating has been observed and the product is found to be consumer unacceptable simply because of the "look" of the package (container deformation and the appearance of less product in the container than claimed).

While controlling the temperature of the post-manufacture product would avoid these problems (the problems occur, but to a very small extent), doing so is not efficient or cost-effective, and many times just not possible.

OBJECTS OF THE INVENTION

It is therefore an object of the invention to provide a method of packaging aqueous solutions that avoid the above mentioned deformation problems, even under warm conditions.

It is another object of the invention to provide a formulation of an aqueous bicarbonate solution, which, when packaged in deformable containers does not result in container bloat or collapse when exposed to temperatures at which such bloating or collapse would otherwise be observed.

It is still another object of the invention to achieve the foregoing objectives when the aqueous solution contains bicarbonate ion.

It is yet another object of the invention to achieve the forgoing objectives when the post-manufacture product is stored at temperatures over about 100° F. for any significant period of time.

Still other objects of the invention will be appreciated by those of ordinary skill in the art.

BRIEF SUMMARY OF THE INVENTION

These and other objects of the invention can be surprisingly achieved by filling or enriching the headspace of the solution (in a closed container) with the gas which would otherwise evolve from the solution. In general, the partial pressure of the particular gas in question needs to be no less than a minimum which is proportional to the concentration of the dissolved gas. The principle is the same whether the dissolved gas is carbon dioxide, oxygen, nitrogen, ammonia, or any other gas. The invention is particularly useful with respect to aqueous solution of bicarbonate ion.

BRIEF DESCRIPTION OF THE SEVERAL VIEWS OF THE DRAWING

Not Applicable

DETAILED DESCRIPTION OF THE INVENTION

The present invention resides in the prevention of deformable container bloating associated with the storage of aqueous solutions that liberate gases in the solutions, especially plastic containers having a non-circular horizontal cross-section, and especially when the liberated gas is carbon dioxide. The above-identified objects are surprisingly achieved by providing the headspace in the container a gas or gaseous mixture which is enriched with the same gas as the gas in solution.

The "enriched" headspace gas (a) can be added to the container before or after filling the container with the solution that the container is intended to hold or (b) can result from leaving the container open or vented for a sufficient time after filling with the solution so as to allow the evolving gas to displace a portion or all of the gas otherwise filling the headspace.

The gas of concern ($g_c$) partial pressure in the headspace will vary from gas to gas. The minimum partial pressure needed to achieve the results of the invention may be calculated based upon the relevant gas evolving reactions involved in the system. For the carbon dioxide gas generation from bicarbonate ion containing systems, the relevant reactions include:

$$HCO_3^- \leftrightarrows CO_3^{-2} + H^+$$

$$HCO_3^- + H_2O \leftrightarrows H_2CO_3 + OH^-$$

$$2HCO_3^- \leftrightarrows H_2CO_3 + CO_3^{-2}$$

$$H_2CO_3 \leftrightarrows H_2O + CO_2$$

and $$H_2O \leftrightarrows H^+ + OH^-$$

These equilibria allow one to calculate the $CO_2$ concentration in solution. Since the concentration of the carbon dioxide in the headspace is proportional to the concentration of carbon dioxide in solution, carbon dioxide will continue to leave the solution as gaseous carbon dioxide until the appropriate concentration is reached or exceeded. By creating a headspace that has a carbon dioxide concentration (or partial pressure) at or in excess of that which the solution seeks to achieve, the driving force behind evolution of additional carbon dioxide is eliminated and the evolution of carbon dioxide gas does not take place. In order to achieve the benefits of the invention when bicarbonate ions are present in solution and carbon dioxide is the gaseous species in question, the headspace should be enriched in carbon dioxide to a level of at least 10% v/v based on the total headspace volume, preferably about 25% v/v to about 80% v/v, more preferably about 25% v/v to about 75% v/v, still more preferably 40% v/v to about 60% v/v, most preferably about 50 v/v.

The same principles hold with any other gas forming reactions where the resulting gas is in solution and contained in a deformable container having a headspace of any size. Alternative gases in solution for which the present invention will prevent container bloating include oxygen, nitrogen, and ammonia, to name a few. Others will be apparent to those of ordinary skill in the art. In general, where there is more than one gaseous species and those gaseous species do not interconvert through the equilibria at play in the system, only the gaseous species having the tendency to change between a dissolved species and a gaseous species (or vice-versa) needs to be taken into account, although exceptions may vary. Hence, in a solution having a significant amount of bicarbonate dissolved therein and only the amount of oxygen and nitrogen that would result from prior exposure of the aqueous medium to the environment, the oxygen and nitrogen species may be neglected. Alternatively, where the system would give rise to a significant amount of oxygen generation, but not carbon dioxide, nitrogen and carbon dioxide which might be present due to prior exposure of the aqueous medium to the ambient air, then oxygen is the only gaseous species which needs to be taken into account. As a means of determining which gaseous species need to be taken into account, one can prepare the solution of interest with headspace filled with ordinary air and subject the solution to typical storage conditions (or to accelerated conditions). Measurement of the gas evolution from the liquid phase to the gaseous phase will determine which gaseous species need to be subjected to the present invention conditions. Variations on this theme will be apparent to those of ordinary skill.

Turning to the preferred embodiments, the aqueous solution contains bicarbonate ion, which, in the absence of the present invention, will generate carbon dioxide in solution and ultimately evolve gaseous carbon dioxide. The solutions will contain other components and the total formulations may find utility as mouthwashes, deodorants, body washes, shampoos, laundry and dishwashing detergents, household cleaners, etc. Particular formulations will be apparent to those of ordinary skill in the respective arts.

The containers for use in the present invention are deformable containers which are not permeable to the intended container contents and not reactive with the intended container contents. They are of a shape and thickness such that under conditions of commercial use, storage, and/or shipment, gas evolution from the solutions contained therein develop pressures sufficient to deform the container noticeably.

Container thickness is generally dictated by cost, manufacturing needs, and requirements of maintaining the integrity of the container itself. Hence, where container bloating is a problem, thicker containers may have been used to resist mounting pressure from evolved gas, when it occurs. In addition to overcoming the deformation problem of deformable containers, the present invention allows for the use of thinner walled containers (thus reducing cost) as well as increases the range of materials that may be utilized for containers. For example, with a 5 mil thick container which does not deform with a particular bicarbonate solution because the shape and thickness are sufficient to withstand the pressures generated, by use of the invention, a thinner material may be utilized, thus saving in the cost and amount of container material used. Alternatively, a weaker (but less costly or more environmentally friendly) material which could not previously be used, may now be employed for containing the solution.

Furthermore, the present invention allows for use of a wider variety of container shapes with such solutions, since odd shapes have more structural weak points and may be easier to manufacture with materials which have heretofore been too weak to use to contain solutions which generate gases with the accompanying increase in internal pressure.

While filling the headspace with pure gas ($g_c$) will prevent the evolution of that same gas from the liquid phase to the headspace, if the $g_c$ concentration is substantially in excess of the concentration of that gas in the liquid phase, an opposite phenomenon may occur. In this situation, the liquid phase, if not saturated with $g_c$, will take up additional $g_c$ from the headspace in an effort to reach equilibrium. This uptake results in reducing the pressure within the container and potentially results in the container walls collapsing in. Therefore, in a preferred embodiment, the headspace concentration of the $g_c$ is limited to the concentration of that gas in the liquid phase plus or minus 25%, preferably plus or minus 20%, more preferably plus or minus 15%, still more preferably plus or minus 10%, even more preferably plus or minus 5%, most preferably at about the concentration of that gas in the liquid phase.

The present invention will be more fully appreciated from the following examples, which merely exemplify but do not limit the scope of the invention.

EXAMPLES

Example 1

Aqueous solutions containing various concentrations of sodium bicarbonate were prepared as set forth below. The solutions were filled in 12 oz flair PET bottles manufactured by Silgan Co. Each bottle was filled precisely to the Child Resistant Closure level and stored at 122° F. for 4 weeks. The fill height of each bottle was measured initially and after 1, 2, and 4 weeks. The change in fill height from the initial baseline is reported in the table below, with each data point being the average of two bottles.

| Sodium | Change in Fill Heights on Storage at 122° F. in inches | | |
|---|---|---|---|
| Bicarbonate Concentration (%) | 1 week | After 2 weeks | 4 weeks |
| 0 | −0.20 | −0.20 | −0.21 |
| 2 | −0.31 | −0.34 | −0.39 |
| 4 | −0.44 | −0.46 | −0.48 |
| 6 | −0.57 | −0.65 | −0.68 |

The data shows that increasingly larger concentrations of bicarbonate concentration in solution result in substantial reduction in fill heights (due to bottle bloating) when the instant invention is not in use. The larger the negative value reported, the greater the bloating of the bottle with concomitant greater increase in the headspace from that which was intended. To confirm that the headspace was actually larger, the headspace volume was measured and is reported below:

| Sodium Bicarbonate Concentration (%) | Headspace in cc after 1 week |
|---|---|
| 0 | 40 |
| 2 | 44 |
| 4 | 51 |
| 6 | 57 |

Example 2

An aqueous solution containing 4% sodium bicarbonate was prepared. The solution was filled in 12 oz flair PET bottles precisely up to the Child Resistant Closure level. This resulted in a 28 cc headspace in the bottle. A volume of carbon dioxide gas was added to the bottle at ambient temperature and pressure using a syringe. The bottles were then capped and stored at 122° F. for 1 week. Fill height of each bottle was measured initially and then after 1 week. The change in fill height is reported in the table below. Each data point is the average of two bottles.

| Volume of $CO_2$ | % $CO_2$ Gas | Change in Fill Height (inches) at 122° F. after | | |
|---|---|---|---|---|
| Gas Added (cc) | in Headspace | 1 week | 2 weeks | 4 weeks |
| 0 | 0 | −0.44 | −0.46 | −0.48 |
| 7 | 25 | −0.23 | −0.28 | −0.28 |
| 14 | 50 | −0.25 | −0.25 | −0.30 |
| 21 | 75 | −0.06 | −0.08 | −0.14 |
| 28 | 100 | +0.35 | +0.29 | +0.23 |

The above data indicates that the degree of bottle bloating, i.e., change in fill height, decreases with increasing volume of $CO_2$ gas introduced into the headspace, but that complete replacement of the headspace gases with pure carbon dioxide results in fill height increasing (bottle collapse).

Example 3

Example 2 was repeated using a mouthwash product containing 3% sodium biocarbonate. The mouthwash composition is set forth below:

| Ingredient | Weight % |
|---|---|
| Sodium Bicarbonate | 3.00 |
| Sodium Citrate Dihydrate | 1.00 |
| Zinc Citrate Trihydrate | 0.38 |
| Glycerin | 9.00 |
| Cetyl Pyridinium Chloride | 0.10 |
| Sodium Saccharin | 0.20 |
| Poloxamer 407 | 0.40 |
| Ethanol | 15.00 |
| Flavor | 0.20 |
| D&C Green #5 (1% Solution) | 0.20 |
| Water Balance to | 100.00 |

The changes in fill height for various volumes of $CO_2$ gas in the headspace are summarized in the table below.

| Volume of $CO_2$ Gas Added (cc) | % v/v $CO_2$ Gas in Headspace | Change in Fill Height after 1 week at 122° F. (inches) |
|---|---|---|
| 0 | 0 | −0.44 |
| 7 | 25 | −0.38 |
| 14 | 50 | −0.25 |
| 21 | 75 | −0.09 |
| 28 | 100 | +0.42 |

The above data indicates that the degree of bottle bloating, i.e., change in fill height, decreases with increasing volume of $CO_2$ gas introduced into the headspace, but that complete replacement of the headspace gases with pure carbon dioxide results in fill height increasing (bottle collapse).

We claim:

1. A method of preventing a deformable container from deforming when said container has contained therein an aqueous solution, said aqueous solution containing a component therein selected from the group consisting of a dissolved gaseous species and a species which under storage conditions is capable of generating a gaseous species, said method comprising providing a headspace in said container which headspace is enriched in a member selected from the group consisting of the gaseous species which said solution has dissolved therein and the gaseous species which said aqueous solution is capable of generating.

2. The method of claim 1 wherein said aqueous solution contains bicarbonate ions.

3. The method of claim 1 wherein said solution is selected from the group consisting of a mouthwash, a deodorant, a body wash, a laundry detergent, a dishwashing detergent, a household cleanser, a toothpaste, a toothgel, and an industrial cleanser.

4. The method of claim 1 wherein said enriched headspace gas is placed in the container before adding said aqueous solution is added to said container.

5. The method of claim 1 wherein said enriched headspace gas is placed in said container after said aqueous solution is added to said container.

6. The method of claim 1 wherein said enriched headspace gas is generated from said solution in said container and displaces the pre-existing headspace gas in said container.

7. The method of claim 6 wherein said aqueous solution is placed in said container and capped with one-way vented cap, said cap allowing said pre-existing headspace gas to be displaced by gas evolving from said aqueous solution, and sealing said vented cap.

8. The method of claim 1 wherein said gaseous species is carbon dioxide.

9. The method of claim 1 wherein said enrichment of said gaseous species in said headspace is enriched so that at least 10% v/v of the headspace volume is said gaseous species.

10. The method of claim 1 wherein said enrichment of said gaseous species in said headspace is enriched so that 20% v/v to about 80% v/v of the headspace volume is said gaseous species.

11. The method of claim 1 wherein said enrichment of said gaseous species in said headspace is enriched so that 25% v/v to about 75% v/v of the headspace volume is said gaseous species.

12. The method of claim 1 wherein said enrichment of said gaseous species in said headspace is enriched so that 40% v/v to about 60% v/v of the headspace volume is said gaseous species.

13. The method of claim 1 wherein said enrichment of said gaseous species in said headspace is enriched so that about 50% v/v of the headspace volume is said gaseous species.

14. In a deformable container having therein a headspace and an aqueous solution, said solution containing a member selected from the group consisting of a dissolved gas and a species capable of generating a gas whereby under certain conditions of storage said gas is capable of leaving said solution for said headspace resulting in container deformation, the improvement comprising an effective enrichment of said headspace gas with the same gaseous component dissolved in or capable of being generated by said solution whereby said container deformation is reduced or prevented.

* * * * *